US007213339B2

(12) United States Patent
Öhman et al.

(10) Patent No.: US 7,213,339 B2
(45) Date of Patent: May 8, 2007

(54) METHOD OF MANUFACTURING A MICROSCALE NOZZLE

(75) Inventors: Per Ove Öhman, Uppsala (SE); Per Andersson, Uppsala (SE)

(73) Assignees: Gyros AB, Uppsala (SE); Amic AB, Uppsala (SE)

( * ) Notice: Subject to any disclaimer, the term of this patent is extended or adjusted under 35 U.S.C. 154(b) by 353 days.

(21) Appl. No.: 10/450,177

(22) PCT Filed: Dec. 12, 2001

(86) PCT No.: PCT/SE01/02753

§ 371 (c)(1),
(2), (4) Date: Jun. 11, 2003

(87) PCT Pub. No.: WO02/47913

PCT Pub. Date: Jun. 20, 2002

(65) Prior Publication Data

US 2004/0055136 A1 Mar. 25, 2004

(30) Foreign Application Priority Data

Dec. 12, 2000 (SE) ..... 0004594

(51) Int. Cl.
*B21D 53/76* (2006.01)

(52) U.S. Cl. ..... 29/890.1; 29/846; 347/47; 347/65

(58) Field of Classification Search ..... 29/890.1, 29/611, 25.35, 846, 847, DIG. 16; 347/44, 347/47, 63, 65; 216/27; 219/121.69
See application file for complete search history.

(56) References Cited

U.S. PATENT DOCUMENTS

| | | | | |
|---|---|---|---|---|
| 4,935,624 A | | 6/1990 | Henion et al. | |
| 5,421,071 A | * | 6/1995 | Kanegae et al. | 29/890.1 X |
| 5,575,929 A | | 11/1996 | Yu et al. | |
| 5,781,994 A | | 7/1998 | Fouillet et al. | |
| 5,872,010 A | | 2/1999 | Karger et al. | |

FOREIGN PATENT DOCUMENTS

| | | | | |
|---|---|---|---|---|
| DE | 196 38 501 A1 | | 4/1998 | |
| GB | 2219129 | * | 11/1989 | 29/25.35 X |
| JP | 5-78138 | * | 3/1993 | 29/890.1 |
| JP | 5-169667 | * | 7/1993 | 29/890.1 |
| WO | WO 00/30167 A1 | | 5/2000 | |

* cited by examiner

*Primary Examiner*—A. Dexter Tugbang
(74) *Attorney, Agent, or Firm*—Birch, Stewart, Kolasch & Birch, LLP

(57) ABSTRACT

Method of manufacturing a microscale nozzle, comprising the steps of forming a microscale channel in the top surface of a substrate, said microscale channel comprising an inlet end and a nozzle-end, depositing a nozzle-forming layer in a section of the microscale channel, and removing material from the substrate at the nozzle-end of the microscale channel to expose at least a portion of said nozzle-forming layer. The manufactured microscale nozzle may be used for transferring a liquid sample form a microchip fluidic system into an external analytical device.

11 Claims, 8 Drawing Sheets

METHOD OF MANUFACTURING A MICROSCALE NOZZLE

This application is the national phase under 35 U.S.C. § 371 of PCT International Application No. PCT/SE01/02753 which has an International filing date of Dec. 12, 2001, which designated the United States of America.

1. Field of the Invention

The present invention relates to microscale fluidic devices and methods for their manufacture. More specifically, the invention relates to a new microscale nozzle and a method of manufacturing the same.

2. Prior Art

Extensive efforts are currently taking place to reduce the volumes of reagents and samples used in assays and new devices which are capable of performing assays on volumes of the order of nanolitres and picolitres are under development. However, it is not possible to perform all desired evaluation on the chip, and sometimes the sample has to be transferred into an external analytical device. This transfer may be done in several different ways, such as by an outlet-port on the chip which is directly connected to an inlet-port on the analytical device, or by a nozzle on the chip whereby the transfer is performed by droplet, spray or steam. One type of analytical devices of special interest is mass spectrometers.

Mass spectrometers are often used to analyse the masses of components of liquid samples obtained from analysis devices such as liquid chromatographs. Mass spectrometers require that the component sample that is to be analysed be provided in the form of free ions and it is usually necessary to evaporate the liquid samples in order to produce a vapour of ions. This is commonly achieved by using electrospray ionisation. In electrospray ionisation (ESI), a spray can be generated by applying a potential (in the order of 2–3 kV) to a hollow needle (nozzle) through, which the liquid sample can flow. The inlet orifice to the mass spectrometer is given a lower potential, for example 0V, and an electrical field is generated from the tip of the needle to the orifice of the mass spectrometer. The electrical field attracts the positively charged species in the fluid, which accumulate in the meniscus of the liquid at the tip of the needle. The negatively charged species in the fluid are neutralised. This meniscus extends towards the oppositely charged orifice and forms a "Taylor cone". When the attraction between the charged species and the orifice exceeds the surface tension of the tip of the Taylor cone, droplets break free from the Taylor cone and fly in the direction of the electrical field lines towards the orifice. During the flight towards the orifice the liquid in the droplets evaporates and the net positive charge in the droplet increases. As the net charge increases, the columbic repulsion between the like charges in the droplet also increases. When the repulsion force between these like charges exceeds the liquid surface tension in the droplet, the droplet bursts into several smaller droplets. The liquid in these droplets in turn evaporates and these droplets also burst. This occurs several times during the flight towards the orifice.

U.S. Pat. No. 4,935,624 teaches an electrospray interface for forming ions at atmospheric pressure from a liquid and for introducing the ions into a mass analyser. This device has a single electrospray needle. Mass spectrometers are expensive devices and usually they spend a lot of time idle as the samples which, are to be analysed are often loaded one at a time into the electrospray. In order to increase the effective working time of mass spectrometers it is known to connect several input devices such as liquid chromatographs sequentially to a single electrospray nozzle. The use of the same nozzle for several samples leads to a risk of cross-contamination and the measures taken to avoid this, such as rinsing between samples, lead to extra costs and decrease the effective working time.

In U.S. Pat. No. 5,872,010, some microscale fluid handling systems of this type are described, and they are based on microfabricated chips. As shown in FIG. 1*a*, this document teaches an embodiment comprising a microchip substrate 6 containing a series of independent channels or grooves 12, fabricated in a parallel arrangement along with their associated sample inlet ports 8 and outlet ports/nozzles 10, in a surface of a planar portion of the microchip. In another embodiment of a device described in this document, the channels can be arranged in a spoke arrangement with the inner ends of the channels connected to a common exit nozzle.

U.S. Pat. No. 5,872,010 further teach that the exit end 10 of the channel(s) 12 may be configured and/or sized to serve as an electrospray nozzle (FIG. 1*a*). In order to minimise cross-contamination between the exit ends 10, the edge surface 14 of the substrate either has to be recessed 16 between adjacent exit ports as shown in FIG. 1*b*, or comprised of a non wetting material or chemically modified to be non-wetting. Unfortunately it has been found that these measures are not sufficient as the resulting electrospray is unsatisfactory, and that cross-contamination still may occur.

Attempts have also been made to attach prefabricated nozzles 18 to microscale channels 12 (FIG. 1*c*). This technique comprises the step of fabricating the nozzle 18, and the delicate step of attaching and aligning the nozzle 18. From an electrospray point of view, this system is the most preferred one, but it is certainly not suitable for mass-production.

The microscale channels shown in FIGS. 1*a*–1*c* are enclosed, e.g. a top surface comprising open microscale channels or grooves is covered by a transparent or non-transparent cover.

In WO 00/30167 Tai et al disclose a method of fabricating a polymer based micromachined electrospray nozzle structure as an extension of a microscale channel. As this method involves several steps of high precision patterning and as it is a silicon-based process, it requires advanced production means, which leads to a relatively expensive process.

SUMMARY OF THE INVENTION

As reuse of electrospray systems increases the risk for contamination of the test sample, it is of great interest to produce disposable electrospray systems. Therefore a new method to manufacture microscale nozzles, especially electrospray nozzles, suitable for mass-production is needed.

An object of the present invention therefore is to provide a new method to manufacture microscale nozzles, especially electrospray nozzles, suitable for mass-production.

Another object of the present invention is to provide a new microscale nozzle, especially an electrospray nozzle, suitable for mass-production.

These objects and other objects of the invention are achieved by the methods of manufacturing in claims 1 and 11, by the nozzle as defined in claim 12, and by the microscale fluid handling systems of claims 13 and 15. Embodiments of the invention are defined in the dependent claims.

The expression "forming the microscale channel in the top surface of the substrate" in claim 1 means that the step is carried out by the same manufacturer as the one who deposits the nozzle forming layer or by a separate manufacturer.

DETAILED DESCRIPTION OF THE INVENTION

Embodiments of the invention will now be described with reference to the figures.

Figure 1A:
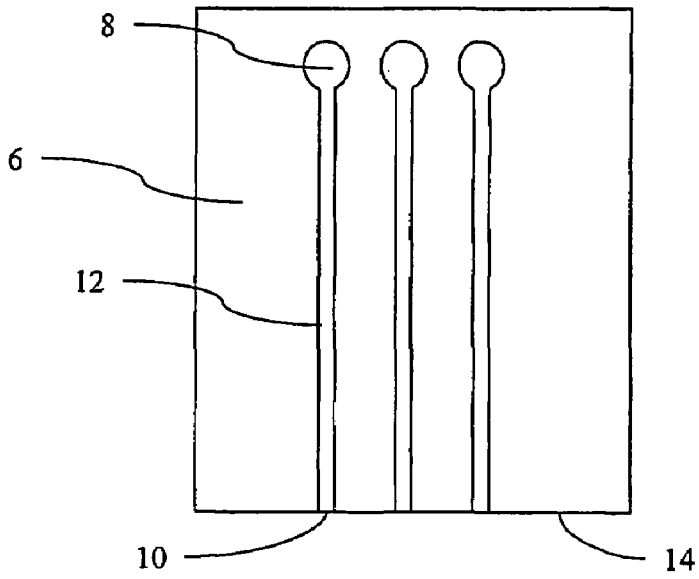
FIGS. 1*a*–1*c* show examples of existing microscale nozzles.
Figure 1B:
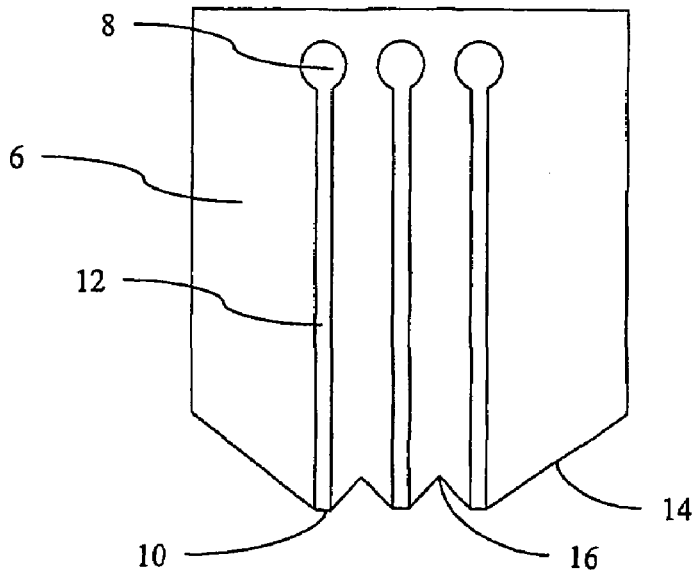
Figure 1C:
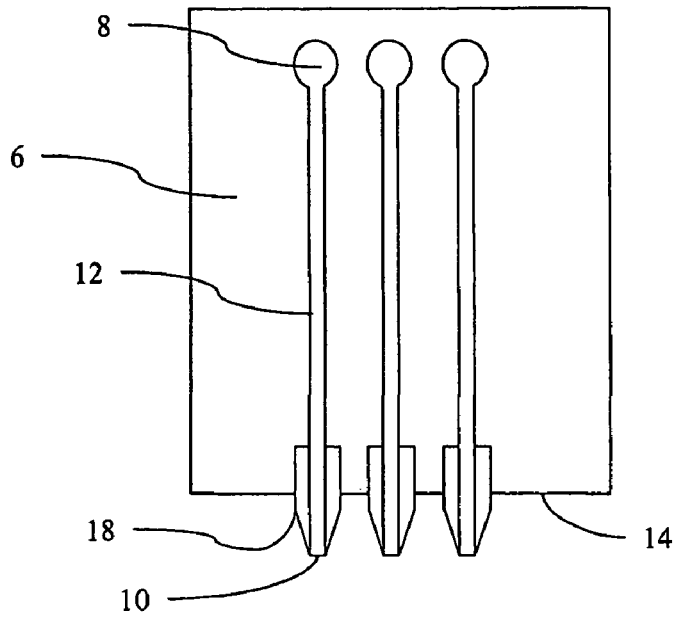
Figure 2A:
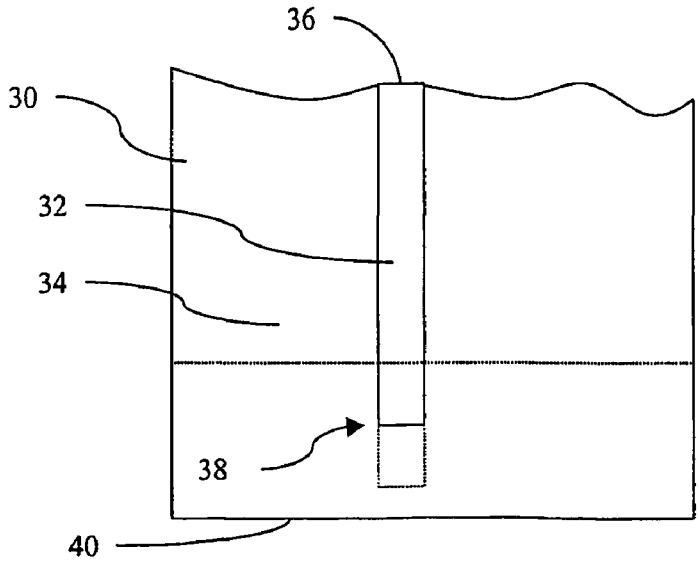
FIGS. 2*a*–2*c* show the main steps in the new method from a topview.
Figure 3A:
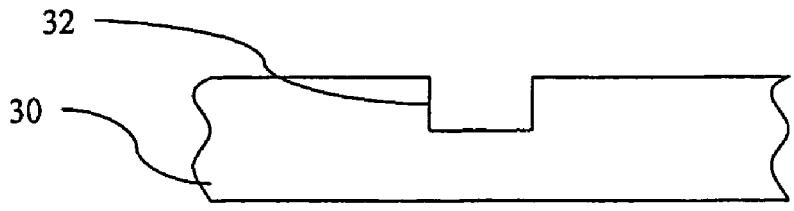
FIGS. 3*a*–3*c* show four possible cross-sectional shapes of a microscale channel
Figure 3B:
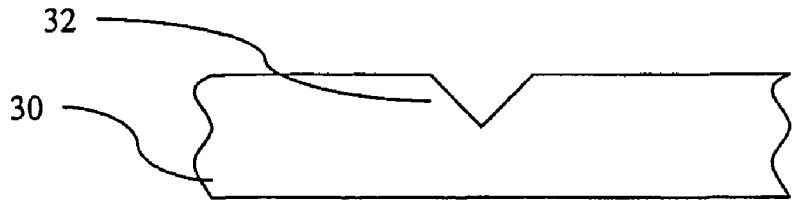
Figure 3C:
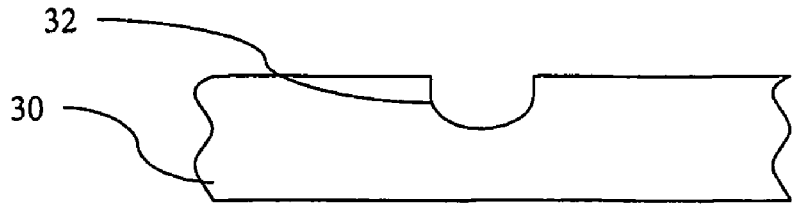
Figure 4A:
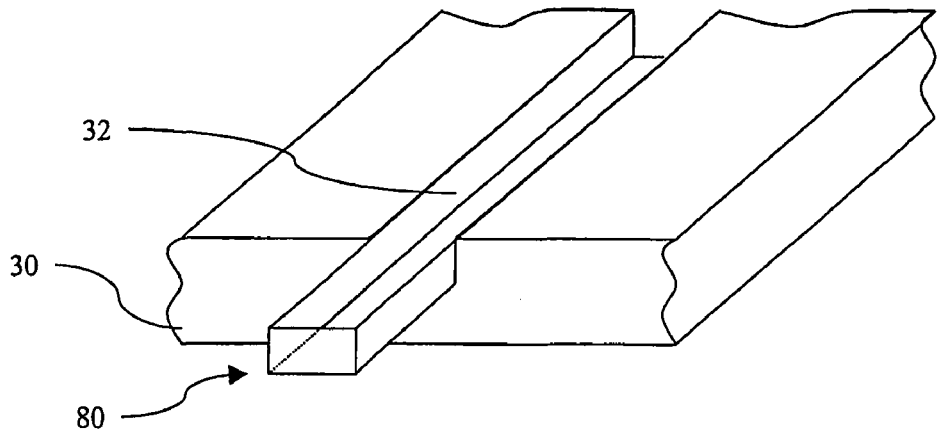
FIGS. 4*a* and 4*b* show in perspective, nozzles manufactured according to the method of the present invention.
Figure 4B:
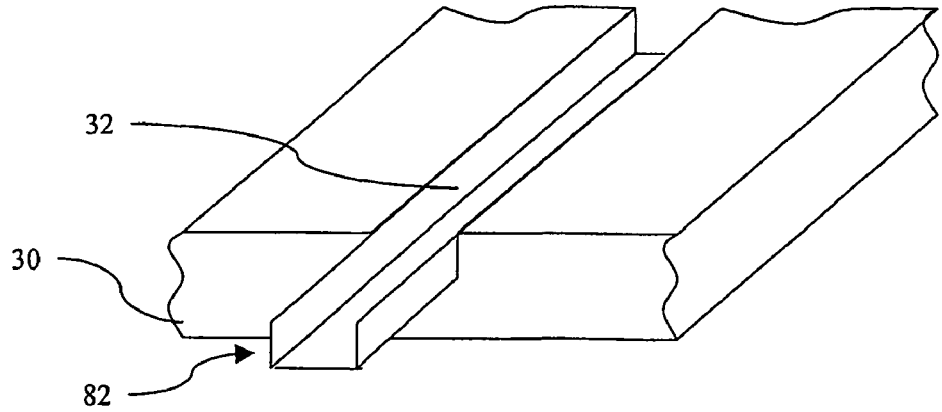
Figure 5A:
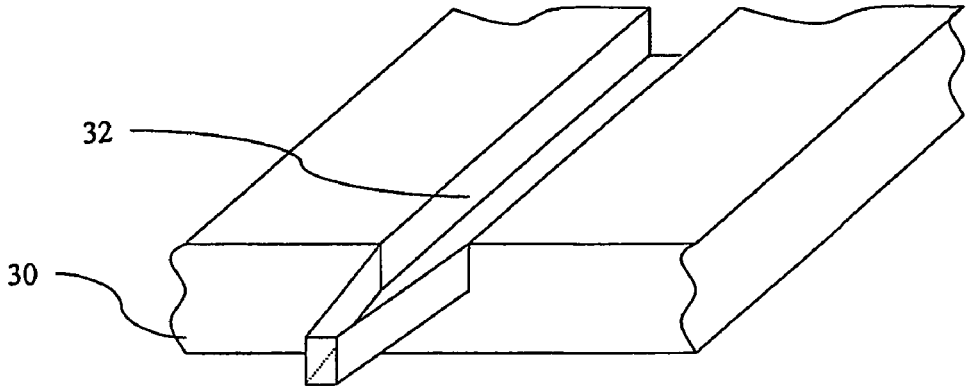
FIGS. 5*a* and 5*b* show in perspective, nozzles having different shapes, manufactured according to the method of the present invention.
Figure 5B:
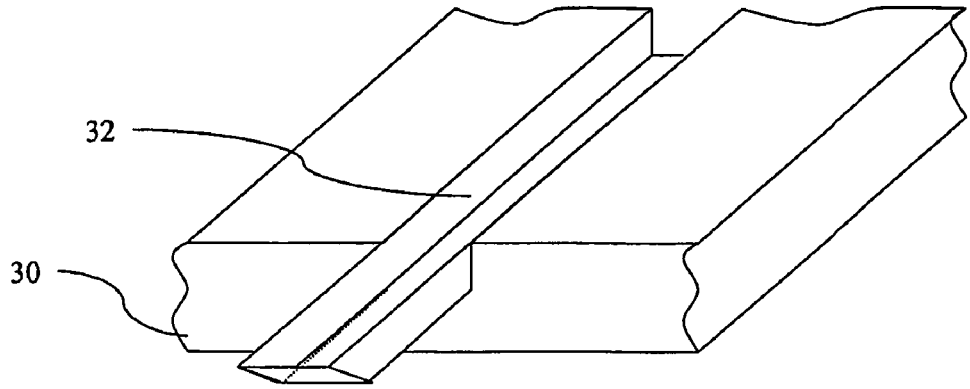

FIG. 2*a* shows a section of a microchip substrate 30 comprising a microscale channel 32, which is formed in the top surface 34 of the substrate 30. To make a fully functional chip, a lid (not shown) is later arranged on top of the substrate 30, which lid has openings through which the samples may be entered. The microchip substrate 30 may be comprised of a polymer or of another mouldable, etchable or machinable material, such as glass or silicon, and the thickness should well exceed the depth of the microscale channel 32. The width and depth of the microscale channel 32 typically is in the order of 1 to 100 μm, and the cross-section may be of any suitable shape, such as shown in FIG. 3. The microscale channel 32 has an inlet end 36, which typically is connected to a microscale fluidic system. At the other end a nozzle-end 38 is located a distance from the edge 40 of the substrate 30, and the channel 32 either terminates at or extends beyond the nozzle-forming end 38. This nozzle-end 38 will later be transformed into a nozzle. In case the channel 32 terminates at the nozzle-end 38 the nozzle will be provided with an end-wall 80, as shown in FIG. 4*a*, and if the channel extends, as indicated by the dotted lines in FIG. 2*a* and 2*b*, the nozzle will have an open end 82 in the direction of the channel (FIG. 4*b*). It should be noted that the nozzle in both cases lacks an upper wall or lid, and therefore both designs have equal functionality. The nozzle-end 38 may have several different shapes both with respect to the width and the depth, as shown in FIG. 5*a* to 5*c*.

Figure 2B:
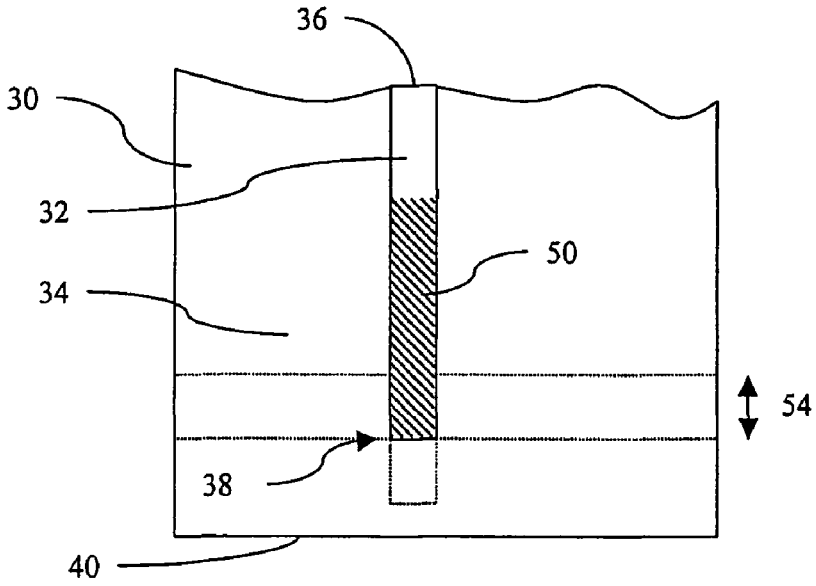

In FIG. 2*b*, a nozzle-forming layer 50 is deposited in the microscale channel 32, extending from the nozzle-end 38 towards the inlet end 36. The nozzle-forming layer 50 covers both the bottom and the sidewalls of the channel, but it does not cover any part of the top surface 34 of the substrate 30. The nozzle-forming layer 50 may either be electrically conductive or non-conductive, whereas in the latter case the electrical potential needed for the electrospray process is provided by an upstream electrode in the fluidic system. A conducting nozzle-forming layer 50 may be comprised of a conductive metal such as gold or nickel, but other conductive materials, e.g. conductive polymers, may also be used. A non-conducting nozzle-forming layer 50 may be comprised of a polymer or an inorganic compound such as glass. Various deposition techniques, such as electroplating, physical or chemical vapor deposition (PVD, CVD), spray type deposition or ink-jet type deposition of molten metal may be used to form the nozzle-forming layer 50. To achieve the desired covering for the nozzle-forming layer 50, several different conventional masking and/or removal techniques may be used depending on which deposition technique that is used.

Figure 2C:
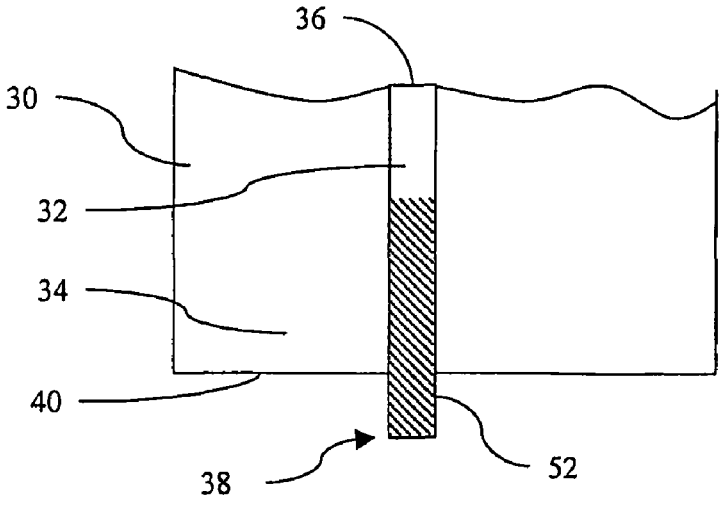

In FIG. 2*c* material at the nozzle-end 38 of the microscale channel has been removed, such that a part of the nozzle-forming layer 50 forms a structure 52 that extends a specified distance from the edge 40 of the substrate. The removal of the substrate material may either be performed chemically such as by etching, or by some mechanical process, e.g. controlled rupture or laser cutting. The total length of the deposited nozzle-forming layer 50 depends on which removal technique that is used. If the removal is performed by using a coarse method, such as controlled rupture, the length of the deposited nozzle-forming layer 50 should well exceed the desired length of the nozzle (L), e.g. 3L or more, and the nozzle-forming layer 50 has to have a high structural strength. This is because the nozzle 52 is kept from breaking loose together with the outer part of the substrate solely by the adhesion of the nozzle-forming layer 50 to the channel 32 in the remaining part of the substrate. One way to avoid unwanted breaking away/ruptures of the nozzle 52, may be to surface modify the nozzle-forming section (54 in FIG. 2*b*) of the microscale channel 32 so that lower adhesion is obtained between the nozzle-forming layer 50 and the channel 32 in that section.

Figure 6A:
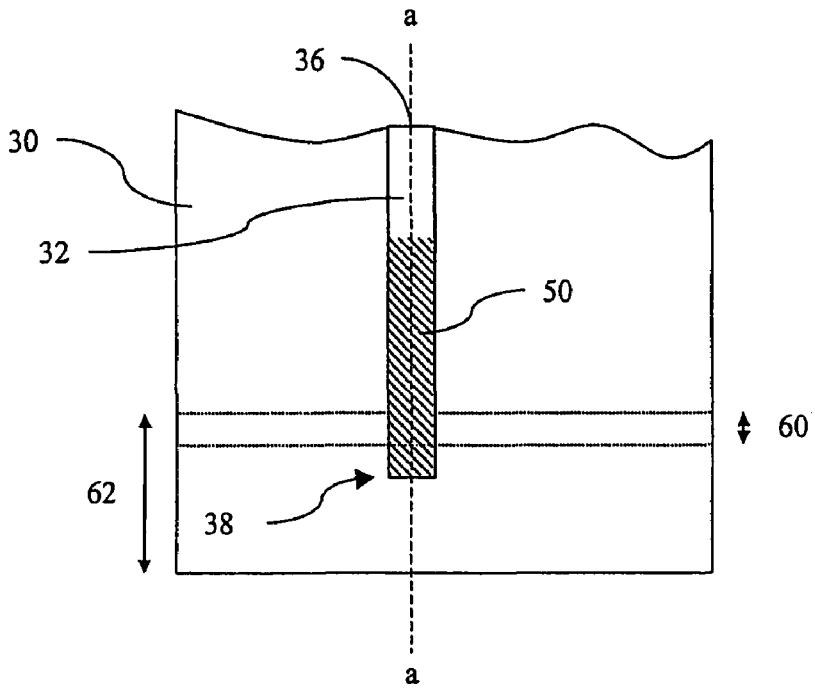
FIG. 6*a* is a topview of one embodiment of the present invention.
Figure 6B:
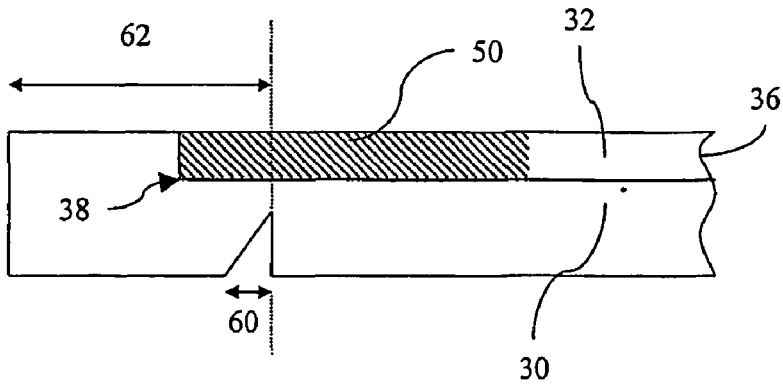
FIG. 6*b* is a cross-sectional view along the line a-a of one embodiment of the present invention.

In a preferred embodiment, shown in FIGS. 6*a* and 6*b*, a notch 60 is formed in the bottom surface of the substrate, in order to provide for a controlled rupture of the substrate by applying sufficient pressure on the upper surface thereof. The notch is arranged such that it, from a topview, intersects the microscale channel 32 at a selected distance from the nozzle-end 38 towards the inlet end 36. The relationship between the microscale channel 32 and the notch 60 is seen in FIGS. 6*a* and 6*b*. The notch 60 may be formed prior to, simultaneously with, or after the forming of the microscale channel 32, and the notch 60 is preferably made as deep as possible, without interference with the microscale channel 32. The outer part 62 of the substrate 30 at the nozzle-end 38 may thus be removed by bending it downwards, whereby the substrate will break along the notch 60. Further, the substrate material has to be chosen to have suitable mechanical and chemical properties, e.g. the material must be brittle but not to such an extent that cracks propagates in other directions than along the notch 60. It has been shown that the result of such an operation is that the nozzle-forming layer 50 in this case will protrude from the edge of the remaining part of the substrate, which will be shown by example below.

If the substrate 30 is comprised of a material that is laser cutable and the nozzle-forming layer 50 is not, this technique can be used for the removal of the outer substrate part.

Figure 7:
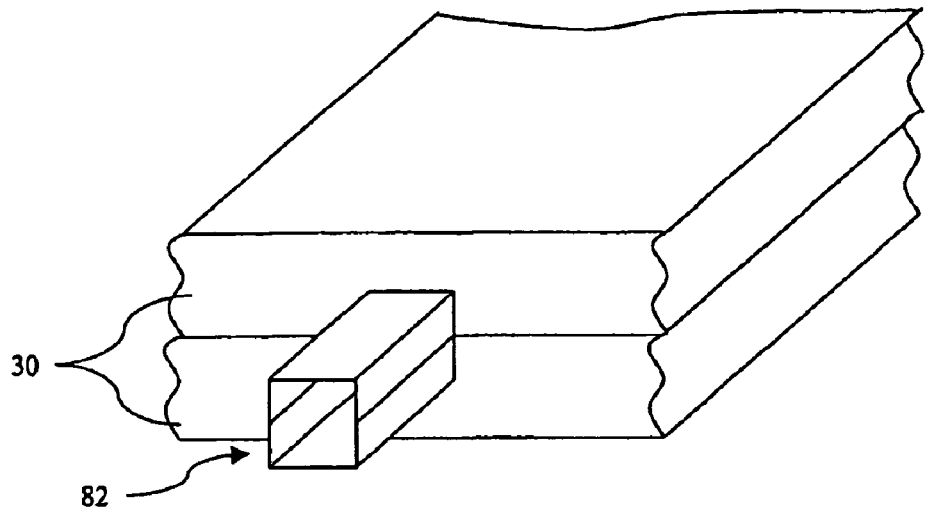
FIG. 7 is a perspective-view of another embodiment of the present invention.

In FIG. 7 another embodiment of the invention is shown, wherein two substrates 30 comprising nozzles 32 with open ends 82 are arranged on top of each other with their upper surfaces 34 such that the nozzles 32 are aligned to form a single nozzle.

EXAMPLE

This example describes one possible way to produce a microchip fluidic system with a polymeric substrate and a metallic nozzle, which process is especially suitable for massproduction.

1. Injection-molding of a polycarbonate-substrate 30 having a microscale channel 32 in the top surface 34 and a notch 60 in the bottom surface.
2. Depositing, on the top surface34 of the substrate 30, a thin metal layer over the nozzle-forming section of the microscale channel 32, using a shade-mask. The deposited metal layer will act as a seed-layer in the electroplating-step described below.
3. Deposition of a positive photoresist-layer to form a thin resist on the top surface 34 of the substrate 30, and a thick resist is made to cover and fill the microchannel 32 using a doctor-blade applying technique. After the deposition, the substrate 30 is soft baked.
4. Exposing the substrate 30 without a mask, such that the thin resist on the top surface 34 of the substrate 30 will be fully exposed together with the thick resist covering the microchannel 32, but the thick resist in the microchannel 32 will remain unexposed.
5. Developing the photoresist-laver, whereby the thin resist on the top surface 34 of the substrate 30 will be removed, but the thick resist in the microchannel 32 will remain.
6. Removing parts of the metal seed-layer not covered by the photoresist-laver, i.e. only the metal seed-layer in the microscale channel 32 will remain. p1 7. Exposing remaining portions of the photoresist-layer through a shadow-mask defining the section of the microscale channel 32, where the nozzle-forming layer 50 is to be deposited. Followed by developing, i.e. the photoresist-laver in the exposed areas is removed.
8. Depositing a 5–10 μm pin nozzle-forming metal layer to form the nozzle-forming layer 50 in parts of the microscale channel 32 free of the photoresist-layer, by electroplating.
9. Breaking the substrate 30 along the notch 60, whereby at least a portion of the nozzle-forming metal layer 50 is exposed.

The invention claimed is:

1. A method of manufacturing a microscale nozzle comprising the steps of:

forming a microscale channel in a top surface of a substrate, said microscale channel comprising an inlet end and a nozzle-end;

depositing a nozzle-forming layer in a section of the microscale channel; and removing an material from the substrate at the nozzle-end of the microscale channel to expose at least a portion of said nozzle forming nozzle-forming layer so that said at least a portion of said nozzle-forming layer protrudes from a remaining surface of the substrate.

2. The method according to claim 1, wherein the nozzle-forming layer comprises a conducting material.

3. The method according to claim 1, further comprising the step of:

forming a notch in the bottom surface of the substrate, said notch being arranged such that, from a topview, intersects the microscale channel at a selected distance from the nozzle-end towards the inlet, end, wherein the step of removing material from the substrate is performed as a controlled rupture, enabled by the notch.

4. The method according to claim 3, characterized in that the steps of forming the microscale channel and forming the notch are performed in one step by injection molding.

5. The method according to claim 1, wherein the step of removing material from the substrate is performed by laser cutting.

6. The method according to claim 1, wherein the step of removing material from the substrate is performed by etching.

7. The method according to claim 1, wherein the substrate is comprised of a polymer.

8. The method according to claim 1 prior to the step of depositing the nozzle-forming layer, further comprising the step of:

surface modifying a nozzle forming section of the microscale channel.

9. The method of manufacturing the microscale nozzle according to claim 1, wherein, the substrate is obtained by injection-molding of a polymer-substrate having said microscale channel in the top surface and a notch in a bottom surface, of said substrate, said notch being arranged such that said substrate, from a topview, intersects the microscale channel at a selected distance from the nozzle-end towards the inlet end, the step of depositing said nozzle-forming layer comprises the steps of:

depositing, on the top surface of the substrate, a thin metal layer over the section of the microscale channel, using a shade-mask, whereby the deposited metal layer will act as a seed-layer for electroplating;

depositing a positive photoresist-layer to form a thin resist on the top surface of the substrate and to form a thick resist to cover and fill the microscale channel using a doctor-blade applying technique;

soft baking of the substrate;

exposing the substrate without a mask, such that the thin resist on the top surface of the substrate is fully exposed together with the thick resist covering the microscale channel, but the thick resist in the microscale channel remains unexposed;

developing the photoresist-layer, whereby the thin resist on the top surface of the substrate is removed, but the thick resist in the microscale channel remains;

removing parts of the metal seed-layer not covered by the photoresist-layer;

exposing the remaining photoresist-layer through a shadow-mask defining the section of the microscale channel, where the nozzle-forming layer is to be deposited;

developing the photoresist-layer, whereby the thin resist in exposed areas is removed; and electroplating a 5–10 μm nozzle-forming metal layer to form said nozzle-forming layer in parts of the microscale channel free of the photoresist-layer, and the step of removing material from the substrate further comprises a step of breaking the substrate along the notch.

10. The method according to any of claim 1 or 2, wherein the microscale channel terminates at the nozzle-end.

11. The method according to any of claim 1 or 2, wherein the microscale channel extends past the nozzle-end.

* * * * *